United States Patent [19]

Boudot et al.

[11] 4,430,173

[45] Feb. 7, 1984

[54] ADDITIVE COMPOSITION, BATH AND PROCESS FOR ACID COPPER ELECTROPLATING

[75] Inventors: Bernard Boudot, Paris; Georges Nury, Frepillon; André Lambert, Louvres, all of France

[73] Assignee: Rhone-Poulenc Specialties Chimiques, Courbevoie, France

[21] Appl. No.: 398,805

[22] Filed: Jul. 16, 1982

[30] Foreign Application Priority Data

Jul. 24, 1981 [FR] France ..... 81 14394

[51] Int. Cl.[3] ..... C25D 3/38

[52] U.S. Cl. ..... 204/52 R; 204/DIG. 2

[58] Field of Search ..... 204/52 R, 44, 106, 123, 204/DIG. 2

[56] References Cited

U.S. PATENT DOCUMENTS 4,036,710 7/1977 Kardos et al. ..... 204/52 R 4,036,711 7/1977 Kardos et al. ..... 204/52 R 4,038,161 7/1977 Eckles et al. ..... 204/52 R

OTHER PUBLICATIONS

Ray Q. Brewster, "Organic Chemistry", p. 731, (1949).

Chemical Abstracts, 82, No. 26, p. 415, 177072u, Jun. 30, 1975.

Yu E. Gerenrot et al., Zashch, Met., 11, (1), pp. 95–98, (1975).

*Primary Examiner*—G. L. Kaplan

*Attorney, Agent, or Firm*—Burns, Doane, Swecker & Mathis

[57] ABSTRACT

Additive composition for an acid copper electroplating bath, which bath being well adapted for the copper plating of printed circuits, is comprised of (1) the sodium salt of ω-sulfo-n-propyl N,N-diethyldithiocarbamate, (2) polyethylene glycol having an average molecular weight ranging from about 6,000 to 20,000, (3) crystal violet, and (4) sulfuric acid.

12 Claims, No Drawings

ADDITIVE COMPOSITION, BATH AND PROCESS FOR ACID COPPER ELECTROPLATING

BACKGROUND OF THE INVENTION

1. Field of the Invention

The present invention relates to an additive for an acid electrolytic copper plating bath, a process for the preparation thereof and the copper electroplating of printed circuits therewith.

2. Description of the Prior Art

A wide variety of additive compositions for acid copper electroplating baths are of course well known to this art.

Thus, French Pat. No. 1,255,271 features acid copper electroplating baths containing one or more basic dyestuffs comprising, in particular, an ethenyl chromophore, amino compounds devoid of carbonyl groups, an organic sulfonic acid, or a water-soluble salt of such acid, which comprise at least one azido group in its molecule, as an additional brightener an organic compound having at least one carbon atom bonded exclusively to a hetero-atom, and which bears a hycrocarbon substituent bonded via a sulfur and/or nitrogen atom and having a hydrogen replaced by a sulfonic acid group, a thioamide or isothioamide which bears a sulfonic acid substituent bonded to the nitrogen atom of the thioamide or isothioamide group via a hydrocarbon radical, and a thiourea derivative in which at least one nitrogen atom is replaced by an alkyl or aryl radical bearing an ether, hydroxyl or carboxyl group.

Furthermore, according to Belgian Patent No. 572,186, acid copper electroplating baths are known which contain an amount of organic sulfonic acids, or the water-soluble salts thereof, which comprise at least one azido group in the molecule, an additional amount of sulfoalkyl esters of N-monosubstituted or N-disubstituted dithiocarbamic acids, or the water-soluble salts thereof, an additional amount of 1,3,5-triazine-2,4,6-tris-(mercaptoalkanesulfonic acids) or water-soluble salts thereof, and an additional amount of certain agents for improving the ductility of the coatings which result therefrom.

The particular additives described in the aforesaid patents are not satisfactory, however, notably because they degrade relatively rapidly during their use and their stability at temperatures above 25° C. is low. Compare also U.S. Pat. Nos. 4,036,710, 4,036,711 and 4,038,161; *Chemical Abstracts*, 82, No. 26, p. 415, 177072u (June 30, 1975); Gerenrot et al, *Zashch. Met.*, 11 (1), pp. 95–8 (1975).

SUMMARY OF THE INVENTION

Accordingly, a major object of the present invention is the provision of an improved additive composition for acid copper electroplating baths, which composition is conspicuously devoid of those disadvantages and drawbacks above outlined, and which is characterized by:

(i) low degradability in the bath during operation, providing for a significant increase in the useful life of the bath and a low consumption of product;

(ii) excellent stability at temperatures above 25° C., providing for the consumption of additive, at such temperatures, which is two to three times lower than that required with the known additives;

(iii) the option of utilizing a very wide range of current densities, for example, from 1 to 10 A/dm$^2$, and (iv) the option of utilizing a very wide range of additive concentrations without adversely affecting the quality of the electrolytic deposit.

Briefly, the present invention features an additive for an acid electrolytic copper plating bath, comprising (1) the sodium salt of ω-sulfo-n-propyl N,N-diethyldithiocarbamate, (2) a polyethylene glycol having an average molecular weight ranging from about 6,000 to about 20,000, (3) crystal violet and (4) sulfuric acid.

DETAILED DESCRIPTION OF THE INVENTION

More particularly according to this invention, the subject dithiocarbamate has the structural formula:

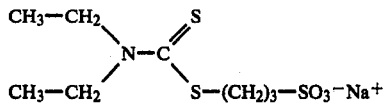

The crystal violet consists of a mixture, of variable composition, of the hydrochlorides of hexamethyl-, pentamethyl- and tetramethyl-para-rosanilines.

In one embodiment of the invention, it is preferred to employ that crystal violet consisting of hexamethyl-para-rosaniline hydrochloride having the structural formula;

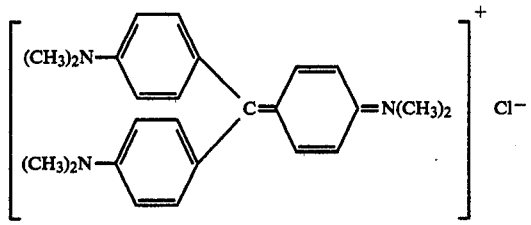

The amounts of respective components of the subject additive composition can vary over wide limits; a suitable concentration for the sodium salt of ω-sulfo-n-propyl N,N-diethyldithiocarbamate ranges from 0.5 to 10 g/l and preferably from 1 to 3 g/l, a suitable concentration for the polyethylene glycol ranges from 10 to 100 g/l and preferably from 15 to 20 g/l, a suitable concentration for the crystal violet ranges from 0.1 to 1 g/l and preferably from 0.2 to 0.5 g/l, and a suitable concentration for the sulfuric acid ranges from 0.1 to 0.5 N and preferably from 0.1 to 0.2 N.

The present invention also relates to a process for the preparation of the aforesaid additive. Such process is characterized in that it comprises the following steps:

(a) the intimate admixture of the four components comprising the subject additive composition; and (b) aging the intimate admixture which results at a temperature ranging from about 58° to 70° C. and preferably from 60° C. to 62° C., for a period of time ranging from about 60 to 200 hours and preferably from 75 to 100 hours.

The components constituting the subject additive are intimately admixed in the proportions set forth above.

The additive prepared in this manner is used in suitable acid copper electroplating bath. The concentration of the additive in the bath can vary from about 2 to 100 ml/l and preferably from 3 and 50 ml/l.

In general, the copper metal plating is carried out at temperatures below 60° and with current densities varying from 0.5 to 10 A/dm$^2$. The amperage range providing the best brightening effects varies according to the proportions of the components of the additive. By using the additive according to the invention, it is possible to broaden the amperage range providing the maximum brightening effect and to increase the certainty of success in practice. Metal substrates which are suitable are all of the types of metals normally appropriate for this use, such as iron, copper, steel, zinc and other common metals or alloys.

The acid copper electroplating baths in which the additives according to the invention are useful principally comprise copper sulfate, the concentration of which can vary from 50 to 250 g/l, and sulfuric acid, the concentration of which can vary from 60 to 250 g/l.

The additive according to the invention has excellent chemical stability in acid baths, such that the latter remain suitable for operation even if relatively high bath temperatures are used.

The additive of the invention is advantageously employed in copper plating operations.

The additive according to the present invention is particularly effective for the electrolytic plating of copper on printed circuits and parts produced by electroforming.

It is also envisaged to employ the subject additive in combination with other known agents, such as conducting salts, wetting agents or agents for inhibiting pore formation.

Thus, the additive according to the invention enables obtainment of copper deposits which are bright, ductile, levelling and resistant to thermal shock. By virtue of its low degradability in the bath during operation, it also provides a significant increase in the useful life of the bath. Furthermore, its excellent stability at temperatures above 25° C. provides for a consumption of additive, at such temperatures, which is on the order of three times lower than that realized with the known additives. Moreover, it too permits use over a very wide range of current densities and also over a very wide concentration of additive in the coppering bath.

The thickness of the copper deposits obtained with the additive of the invention can vary over wide limits; it is convenient, for example, to produce deposits having a thickness ranging from a few microns to 5 mm.

In order to further illustrate the present invention and the advantages thereof, the following specific example is given, it being understood that same is intended only as illustrative and in nowise limitative.

EXAMPLE

(A) Preparation of the additive

The following materials were successively introduced into a 200 liter glass-lined steel reactor:

(i) 186 liters of distilled water and 522 milliliters of $H_2SO_4$ having a concentration of 36 N;
(ii) 65 g of crystal violet;
(iii) 3,095 g of polyethylene glycol having an average molecular weight of 12,000; and
(iv) 186 g of the sodium salt of ω-sulfo-n-propyl N,N-diethyldithiocarbamate.

This mixture was stirred for about two hours and the temperature thereof was then raised to 60° C. over a period of two hours; the mixture was aged at this temperature for 100 hours and then cooled to ambient temperature: this provided about 187 liters of additive.

(B) Application

A bath having the following composition was prepared in a 1,000 liter vessel for the copper metallization of printed circuits:

(i) Copper sulfate ($CuSo_4.5H_2O$): 75 g/l
(ii) Sulfuric acid: 180 g/l
(iii) Chloride: 50 mg/l After electrolysis had been carried out for 10 hours at 1 ampere/dm$^2$ in order to remove the metallic impurities, 5 liters of the additive thus prepared were added: the deposits obtained after this addition were bright, ductile and without internal tension—the structure of the deposited copper was finely particulate and no cracks appeared in the deposit after the thermal shock test (immersion for 10 seconds in solder at 290° C. and then dipping in water).

The useful range of current densities was from 1 to 10 A/dm$^2$ if it was only desired to obtain a bright deposit which was resistant to thermal shock, and from 1 to 8 A/dm$^2$ if, in addition to these properties, it was desired to obtain a finely particulate structure for the copper.

The concentration of additive in the bath can easily be tracked with the aid of the Hull cell test (*Electroplating*, McGraw-Hill Book Company, 1978, pp. 148–150) under the following conditions:

(i) Intensity: 2 amperes
(ii) Duration: 5 minutes
(iii) Temperature: 22°–24° C.
(iv) Stirring: yes
(v) Volume of electrolyte: 250 cm$^3$ In the case of the 1,000 liter vessel, additional 1-liter amounts of additive were added each time the width of the burned zone on the Hull cell plate reached 10 mm. Under these conditions, for a temperature below 26° C., the consumption of additive was between 1 and 2 liters per 10,000 ampere-hours and the life of the bath, before regeneration on active charcoal, was more than 1.5 million ampere-hours.

While the invention has been described in terms of various preferred emobodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. An additive composition for an acid copper electroplating bath, comprising (1) the sodium salt of ω-sulfo-n-propyl N,N-diethyldithiocarbamate, (2) polyethylene glycol having an average molecular weight ranging from about 6,000 to 20,000, (3) crystal violet, and (4) sulfuric acid.

2. The additive composition as defined by claim 1, wherein the concentration of the sodium salt of ω-sulfo-n-propyl N,N-diethyldithiocarbamate ranges from 0.5 to 10 g/l, the concentration of the crystal violet ranges from 0.1 to 100 g/l, the concentration of the crystal violet ranges from 0.1 to 1 g/l, and the concentration of the sulfuric acid ranges from 0.1 to 0.5 N.

3. A process for the preparation of the additive composition as defined by claim 1, comprising:

(a) intimately admixing the components comprising said composition; and (b) aging the intimate admixture which results at a temperature ranging from about 58° and 70° C., for a period of time of from about 60 to 200 hours.

4. The additive composition as defined by claim 2, wherein the concentration of the sodium salt of ω-sulfo-n-propyl N,N-diethyldithiocarbamate ranges from 1 to 3 g/l, the concentration of the polyethylene glycol ranges from 15 to 20 g/l, the concentration of the cyrstal violet ranges from 0.2 to 0.5 g/l, and the concentration of the sulfuric acid ranges from 0.1 to 0.2 N.

5. The process as defined by claim 3, said aging (b) being at a temperature ranging from 60° to 62° C., for a period of time of from 75 to 100 hours.

6. In an acid copper electroplating bath, the improvement which comprises, as an additive composition therefor, the additive composition as defined by claim 1.

7. The acid copper electroplating bath as defined by claim 6, containing copper sulfate and sulfuric acid.

8. The said copper electroplating bath as defined by claim 7, further containing chloride ions.

9. The acid copper electroplating bath as defined by claim 7, the concentration of the copper sulfate therein ranging from 50 to 250 g/l, the concentration of the sulfuric acid therein ranging from 60 to 250 g/l, and the concentration of the additive composition therein ranging from 2 to 100 ml/l.

10. The acid copper electroplating bath as defined by claim 9, the concentration of the additive composition therein ranging from 3 to 50 ml/l.

11. In a method for electrodepositing copper from an aqueous acidic copper plating bath, the improvement which comprises, as the acid copper electroplating bath therefor, the acid copper electroplating bath as defined by claim 9.

12. The method for electrodepositing copper as defined by claim 11, the bath being at a temperature of less than 60° C. and the current density ranging from 0.5 to 10 $A/dm^2$.

* * * * *